US006688366B1

(12) United States Patent
Gambini

(10) Patent No.: US 6,688,366 B1
(45) Date of Patent: Feb. 10, 2004

(54) PAPER-CONVERTING MACHINE WITH RAPIDLY CHANGING EMBOSS CYLINDER MECHANISM

(76) Inventor: Giovanni Gambini, Via A. Omodeo 7, I - 56100 Pisa (IT)

( * ) Notice: Subject to any disclaimer, the term of this patent is extended or adjusted under 35 U.S.C. 154(b) by 135 days.

(21) Appl. No.: 09/630,169

(22) Filed: Aug. 1, 2000

(30) Foreign Application Priority Data

Aug. 6, 1999 (IT) ..... MI9900507 U

(51) Int. Cl.[7] ..... B31F 1/07
(52) U.S. Cl. ..... 156/553; 156/209; 156/582
(58) Field of Search ..... 156/209, 219, 156/582, 324, 290, 291, 553, 580, 578, 555; 162/296, 117

(56) References Cited

U.S. PATENT DOCUMENTS

| | | | | | |
|---|---|---|---|---|---|
| 4,084,761 | A | * | 4/1978 | Kuckherman | 242/58.6 |
| 4,320,162 | A | * | 3/1982 | Schulz | 428/154 |
| 4,627,831 | A | * | 12/1986 | Hirakawa et al. | 493/337 |
| 4,631,109 | A | * | 12/1986 | Hirakawa et al. | 156/472 |
| 5,096,527 | A | * | 3/1992 | Biagiotti | 156/209 |
| 5,344,520 | A | * | 9/1994 | Seki et al. | 156/472 |
| 5,686,168 | A | | 11/1997 | Laurent et al. | |
| 6,048,603 | A | * | 4/2000 | Ruppel et al. | 428/195 |
| 6,053,232 | A | | 4/2000 | Biagiotti | |
| 6,109,326 | A | * | 8/2000 | Leakey et al. | 156/553 |

FOREIGN PATENT DOCUMENTS

| | | | |
|---|---|---|---|
| DE | 3506423 | 4/1986 | |
| DE | 4412862 | 8/1995 | |
| DE | 4413807 | 9/1995 | |
| DE | 29712743 | 10/1997 | |
| EP | 0112981 | 7/1984 | |
| EP | 0265298 | 4/1988 | |
| EP | 0908246 | 4/1999 | |
| JP | 59-185620 | * 10/1984 | ..... B29C/15/00 |
| WO | 9944814 | 9/1999 | |

OTHER PUBLICATIONS

Kijima Yoshimichi, JP 59–185620, Oct. 22, 1984 (abstract).*
European Search Report, Munich, Aug. 31, 2000, Examiner Naeslaud, P.

* cited by examiner

*Primary Examiner*—Jeff H. Aftergut
*Assistant Examiner*—Gladys Corcoran
(74) *Attorney, Agent, or Firm*—Hedman & Costigan, P.C.

(57) ABSTRACT

A convertible machine for surface treatment of paper, in particular of toilet paper, absorbent wipes, towelettes, serviettes, handkerchiefs and the like, comprising, on a roll stand (13), at least one pair of cylinders, one of which (14, 15) is rubber-coated and the other (17, 18) is made of steel, in contact with one another and between which at least one ribbon of paper (11, 12) is made to pass to be subjected to surface treatment, the steel cylinder (17, 18) being set on a support (23) displaceable from a position of contact with the rubber-coated cylinder (14, 15) and carrying at least one further steel cylinder (17', 18' and 17", 18") to be brought into contact with the rubber-coated cylinder (14, 15).

3 Claims, 3 Drawing Sheets

PAPER-CONVERTING MACHINE WITH RAPIDLY CHANGING EMBOSS CYLINDER MECHANISM

The present application claims priority to Italian Patent Application Serial No. MI 1999U 000507, filed Aug. 6, 1999.

BACKGROUND OF THE INVENTION

The present invention refers to a convertible machine for surface treatment of paper.

In the sector of surface treatment of paper, in particular of paper that is subsequently used as toilet paper, absorbent wipes, towelettes, serviettes, handkerchiefs and the like, it is by now customary to make surfaces of the paper provided with various decorations.

These surface decorations are made using different methods; namely, causing pairs of embossing cylinders to interact on a single ribbon or two ribbons of paper which are joined together, where the cylinders are provided with appropriate machinings.

The normal procedure envisages, in fact, that the two ribbons of paper are initially sent to be wound on a corresponding rubber-coated cylinder for guiding them towards the embossing area. This rubber-coated cylinder also constitutes an element of contrast with a respective steel cylinder forming part of the pair that subsequently makes the final paper consisting of one or more ribbons laid on top of one another and joined together, provided with surface decorations. It is then known that, in the presence of the two pairs of steel cylinders and of the respective pair of rubber-coated cylinders, there may possibly be associated a device for dispensing glue, which inserts glue between the two ribbons of paper.

The decorations made on the two ribbons are used to obtain a product having a particular appearance required by the specific customer.

The need thus arises for having available pairs of steel cylinders bearing decorations having different patterns according to the batches of finished paper product that the various customers may request.

In the processing machine it is therefore necessary to provide for replacement of the steel cylinder or pair of steel cylinders bearing a certain pattern with another cylinder or pair of cylinders bearing another pattern. The said replacement involves operations of disassembly of the unit being used and or re-assembly of the unit required by the second treatment process.

These operations determine a loss of time for disassembly and assembly, as well as operations for adjusting the new pairs of steel-to-steel cylinders which have been installed.

SUMMARY OF THE INVENTION

A purpose of the present invention is to provide a machine for surface treatment of paper, in particular in the sector of surface treatment of paper, such as toilet paper, absorbent wipes, towelettes, serviettes, handkerchiefs and the like, which enables the problem of disassembly and/or assembly of the steel cylinders to be avoided in the event of variation of the pattern.

Another purpose of the present invention is to make available a machine that simply enables fast replacement of one steel cylinder or of a pair of steel cylinders that are worn out, with another new cylinder or pair of new cylinders.

These purposes according to the present invention are achieved by providing a convertible machine for surface treatment of paper, for example, toilet paper, absorbent wipes, towelettes, serviettes, and handkerchiefs, comprising, on a roll stand (13), at least one pair of cylinders, one of which (14, 15) is rubber-coated and the other (17, 18) is made of steel, in contact with one another and between which at least one ribbon of paper (11, 12) is made to pass in order to be subjected to surface treatment, characterized in that said steel cylinder (17, 18) is set on a support (23) displaceable from a position of contact with said rubber-coated cylinder (14, 15) and carries at least one further steel cylinder (17', 18' and 17", 18") to be brought into contact with said rubber-coated cylinder (14, 15).

The characteristics and advantages of a convertible machine for surface treatment of paper will emerge more clearly evident from the ensuing description, which is provided purely to furnish an explanatory and non-limiting example, with reference to the attached schematic drawings in which:

DETAILED DESCRIPTION OF THE INVENTION

Figure 1:
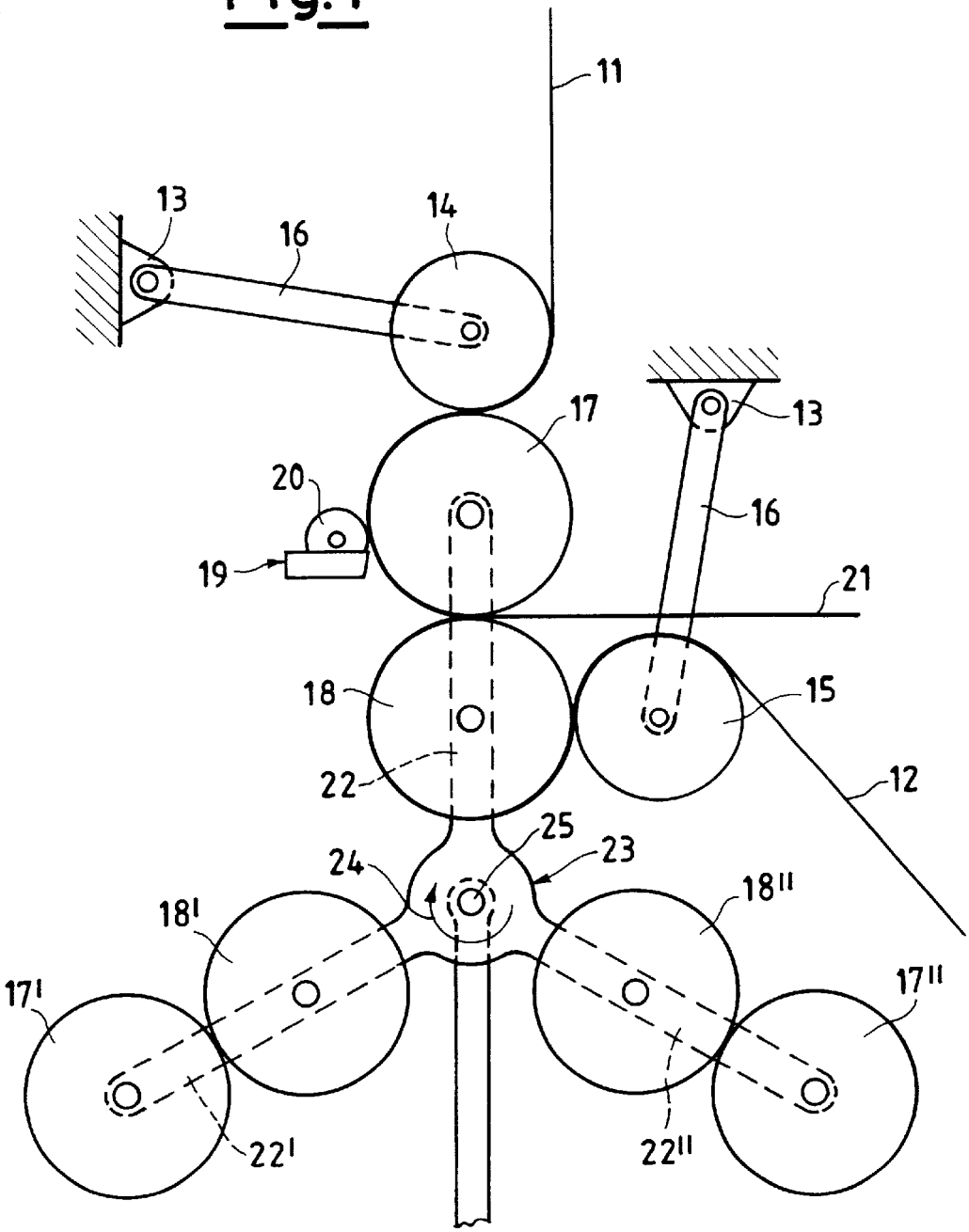
FIG. 1 is a schematic elevation of a first arrangement made according to the present invention.

With reference to FIG. 1, a central part of a convertible machine for surface treatment of paper is shown during the phase of treatment of a pair of ribbons 11 and 12, which arrive from respective rolls (not shown).

The machine carries on a roll stand, designated in some of its parts as 13, pairs of arrangements, such as those illustrated in the figure, for supporting the ends of the cylinders making it up. For reasons of simplicity, reference is therefore made in the description to a single side.

The roll stand thus comprises a first rubber-coated cylinder 14, and a second rubber-coated cylinder 15, which, according to the invention may be displaced since they are, for instance, supported on levers 16.

Operatively associated to these two rubber-coated cylinders 14 and 15 are two steel cylinders 17 and 18 which present their machined surfaces, for example surfaces provided with projecting areas made by machining, for instance milling with a hob or knurling tool, or the turning tool of a lathe, and in general by removal of stock, or by chemical etching.

In addition, to one of these steel cylinders, for example the one designated by 17 in this arrangement shown to provide an example, is associated a glue-distributing assembly 19 which, by means of a roller 20, dispenses a metered quantity of glue on a surface of the ribbon 11 which will come into contact with the corresponding surface of the ribbon 12. In this case, it is possible to say that the two surfaces are the internal ones, the two ribbons glued together then constituting the finished ribbon of paper 21. The glue-dispensing assembly 19 may also be a simple dispensing nozzle or any other type of device.

According to the present invention, moreover, the pair of cylinders 17 and 18 is positioned on a first arm 22 of a rotating support 23, which rotates about a central axis 25, carrying a number of pairs of steel cylinders. In the example of embodiment, which is a non-limiting example, three arms 22, 22' and 22" are provided, which carry pairs of cylinders 17, 18; 17', 18'; and 17", 18".

In this way, in the operative arrangement shown, two pairs of cylinders, one pair 14, 15 rubber-coated, and the other pair 17, 18 made of steel, are provided, in which the rubber-coated cylinder 14, 15 has the function of a contrasting element co-operating with the respective steel cylinder 17, 18, to impress the desired pattern on the respective ribbon of paper 11, 12.

The parts in relief of the pattern of the ribbon of paper 11 then receive the glue before coming into contact with one another and being stuck together, precisely in the areas where the said embossed areas are present.

This type of treatment does not involve any problem until the need arises to obtain a different pattern on the finished paper.

According to the invention, the two cylinders 14 and 15 are moved away from one another by oscillating the levers 16 by means of actuators (not shown), and the glue-dispensing unit 19 is likewise moved away. Then, a further actuator (not shown) is used to rotate the rotating support 23, for instance according to the arrow 24, so as to disengage the pair of cylinders 17 and 18 from the area of operation.

This rotation enables the second arm 22' to bring a new pair of cylinders 17' and 18' into the area of operation, said cylinders, for instance, being provided with a different surface pattern. Once this has been done, the two cylinders 14 and 15 are brought back into contact with the cylinders 17' and 18' by oscillating the arms 16 in a direction opposite to the previous direction. The glue-dispensing unit 19 is then brought back into its former position, and the ribbons of paper 11 and 12 are once again introduced into the machine.

The machine is now ready to perform a new operation of formation of the paper 21 having the new surface pattern.

The particular structure of the machine according to the present invention thus enables maximum operativeness with minimum stoppage time, so eliminating operations of assembly and disassembly or, at least, reducing them to the minimum.

This particular machine is also able to eliminate the down time due to the mere replacement of the steel cylinders when the latter are worn out or deteriorated owing to use. It is in fact also possible to position a number of pairs of cylinders of the same type on the rotating support 23 so as to obtain extremely reduced replacement times.

This is a machine which, in the sector of surface treatment of paper, in particular of toilet paper, absorbent paper, serviettes, handkerchiefs and the like, that involves high amounts of paper to be treated, is extremely effective and useful, capable of solving the problem of time due to stoppages and down time due to operations of assembly and disassembly.

It is evident that the example outlined is only one of the possible embodiments, it being moreover clear that similar arrangements which use the same new and original principle are to be considered included in the sphere of protection of the present invention.

Figure 2:
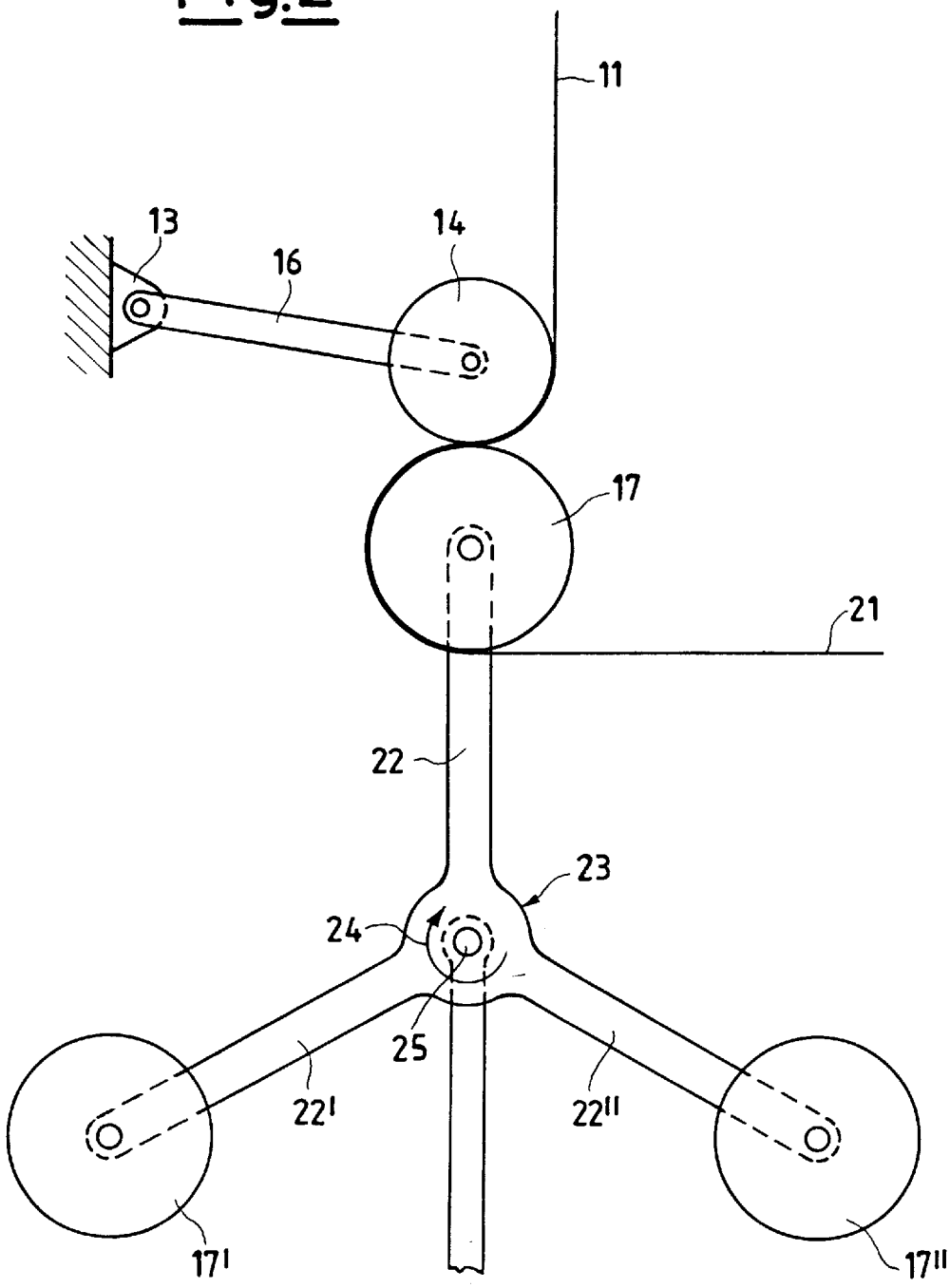
FIG. 2 is an elevation of a second arrangement exemplifying the present invention.

In this connection, FIG. 2 shows a simplified form of the arrangement of FIG. 1, in which the same reference numbers are used for corresponding parts.

It may thus be noted that in this case only one ribbon 11 is fed in, which arrives from a roll (not shown) and which is first wound at least partially on a rubber-coated cylinder 14 located so that it can be displaced on a lever 16 pivoted to the roll stand 13.

Also in this example, the machine is equipped with a rotating support 23 bearing arms 22, 22', 22", which each carry a steel cylinder 17, 17', 17" provided with surface machining or the like, such as a knurled surface.

The ribbon 21 which comes out and which is passed between the rubber-coated cylinder 14 and the steel cylinder 17 is the finished ribbon provided with a given surface treatment.

In the case where it is intended to apply a different surface treatment, it is sufficient to rotate the support 23 and to bring a second steel cylinder 17', with a different surface machining, or else a new steel cylinder for replacement of the old cylinder that is worn out, into contact with the rubber-coated cylinder 14.

Figure 3:
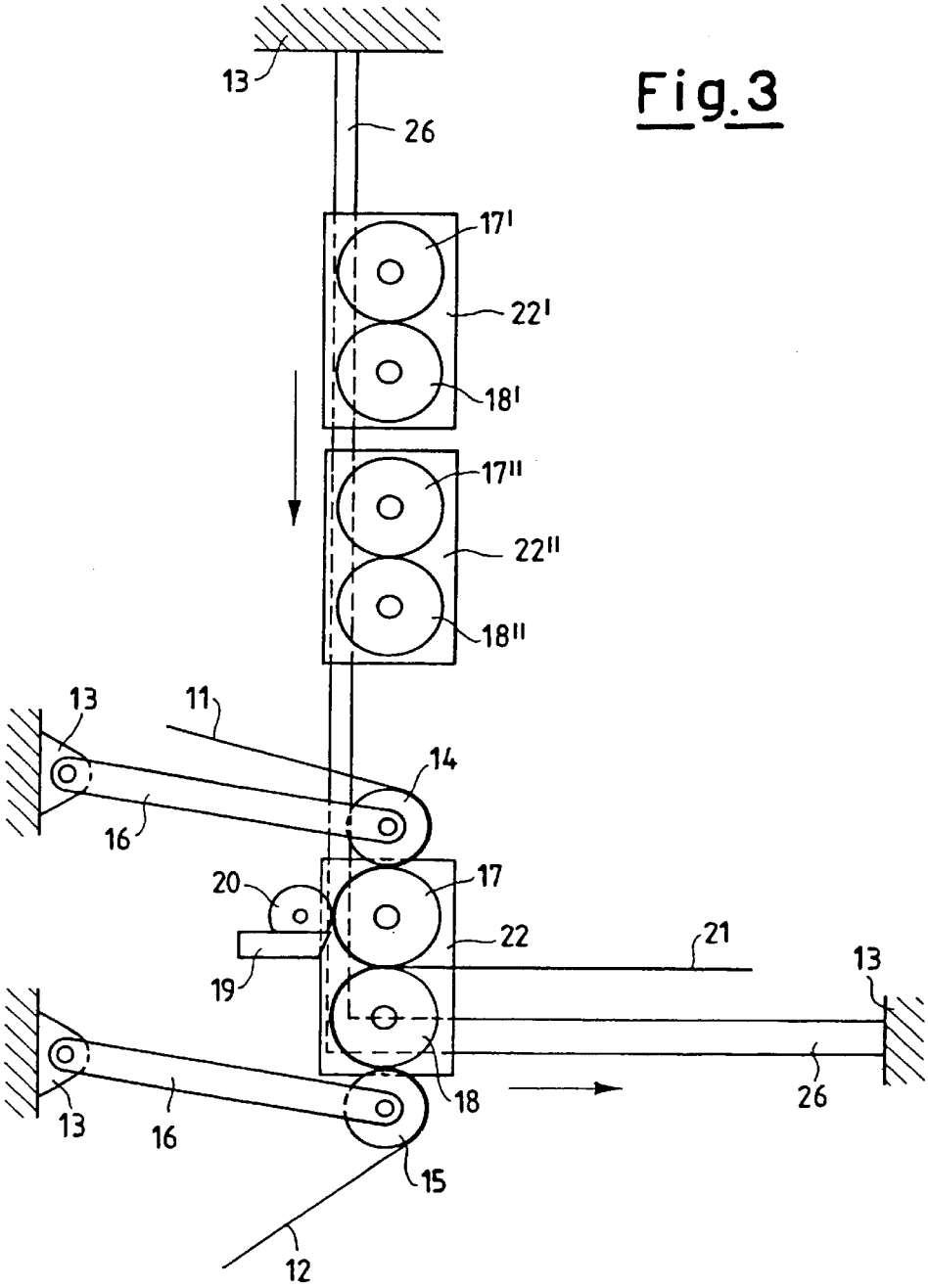
FIG. 3 is an elevation of a third arrangement exemplifying the present invention.

FIG. 3 illustrates a machine in which the parts are differently arranged and which is an application of the same innovative idea. Also in this case, the same reference numbers are used for corresponding parts or parts having the same function.

In fact, the pairs of cylinders that are brought into contact with the rubber-coated cylinders 14 and 15 are arranged in box-like supports 22, 22', 22". These box-like supports 22, 22', 22" can be translated and can slide on a roll stand 13 equipped with a supporting track 26 fixed to the roll stand 13.

The box-like supports 22, 22', 22" may be brought into contact with, and removed from contact with, the rubber-coated cylinders 14 and 15 by translating on the supporting track 26 of the roll stand 13. For this displacement, known actuators (not shown) are provided. Each of the box-like supports contains at least one steel cylinder or, as shown in FIG. 3, pairs of steel cylinders 17, 18; 17', 18'; and 17", 18".

Thus obtained in an equivalent way is the replacement and change of the pairs of steel cylinders 17, 18; 17', 18'; and 17", 18", as for the example illustrated in FIG. 1, with another type of support that does not rotate but translates.

In any case, further modes of solution may be identified, all of which fall within the same innovative idea of the present invention.

What is claimed is:

1. A convertible machine for surface treatment of delicate paper products, said paper products comprising toilet paper, absorbent wipes, towelettes, serviettes, and handkerchiefs, said machine comprising at least two pairs of cylinders, including a first pair of rubber-coated cylinders (14, 15) and a first pair of steel cylinders (17, 18), said rubber coated cylinders are mounted on a roll stand (13) wherein said steel cylinders (17, 18) are in contact with one another and each in turn is in contact with a respective rubber coated cylinder of said first pair of rubber coated cylinders (14, 15), said rubber coated cylinders (14, 15) being supported on oscillating levers (16) and guiding a pair of paper ribbons (11, 12) between said pair of steel cylinders (17, 18) and their respective rubber coated cylinders in order to be subjected to surface treatment, wherein said steel cylinders (17, 18) are set on a support (23), said steel cylinders being displaceable from a position of contact with said rubber coated cylinders (14, 15) by rotation of said support (23) and movement of said oscillating levers (16), wherein said support (23) carries at least a second pair of steel cylinders (17', 18' and 17", 18") which are adapted to be brought into contact with said rubber coated cylinders (14, 15), wherein before passing through said first or second pair of steel cylinders (17, 18; 17', 18' and 17", 18") at least one of said pair of ribbons (11, 12) receives an adhesive dispensed by a glue dispensing-unit (19) on a surface of said at least one ribbon (11, 12) designed to be brought into contact with the other of said pair of ribbons.

2. A machine according to claim 1, characterized in that said rotating support (23) consists of at least two arms (22, 22', 22") rotating about a central axis (25).

3. A convertible machine, for surface treatment of delicate paper products, said paper products comprising toilet paper, absorbent wipes, towelettes, serviettes, and handkerchiefs, said machine comprising at least two pairs of cylinders, including a first pair of rubber coated cylinders (14, 15) and a first pair of steel cylinders (17, 18), said steel cylinders mounted on a box-like support (22) and said rubber coated cylinders are mounted on a roll stand (13) and supported by oscillating levers (16) wherein said steel cylinders (17, 18) are in contact with one another and each in turn is in contact with a respective rubber coated cylinder of said first pair of rubber coated cylinders (14, 15), said rubber coated cylinders (14, 15) guiding a pair of paper ribbons (11, 12) between said pair of steel cylinders (17, 18) and their respective rubber coated cylinders in order to be subjected to surface treatment, wherein box-like support (22) is a translatable and sliding support that is translatable and slides along a supporting track (26) mounted on said roll stand (13) said steel cylinders being displaceable from a position of contact with said rubber-coated cylinders (14, 15) by movement of said box-like support (22) along said supporting track (26), and movement of said oscillating levers (16), wherein said supporting track (26) carries at least one further box-like support (22', 22") comprising a second pair of steel cylinders (17', 18' and 17", 18") which are adapted to be brought into contact with said rubber, coated cylinders (14, 15), wherein before passing through said first or second pair of steel cylinders (17, 18; 17', 18' and 17", 18") at least one of said pair of ribbons (11, 12) receives an adhesive dispensed by a glue dispensing-unit (19) on a surface of said at least one ribbon (11, 12) designed to be brought into contact with the other of said pair of ribbons.

* * * * *